US007299799B2

(12) United States Patent
Albizuri

(10) Patent No.: US 7,299,799 B2
(45) Date of Patent: Nov. 27, 2007

(54) GAS MANIFOLD ASSEMBLY WITH A MOUNTING DEVICE IN A COOKING APPLIANCE

(76) Inventor: Iñigo Albizuri, Calle Uno, 736 Z.I., 44940 Guadalajara, Jalisco (MX)

( * ) Notice: Subject to any disclaimer, the term of this patent is extended or adjusted under 35 U.S.C. 154(b) by 341 days.

(21) Appl. No.: 10/910,427

(22) Filed: Aug. 2, 2004

(65) Prior Publication Data

US 2005/0257784 A1 Nov. 24, 2005

(30) Foreign Application Priority Data

May 20, 2004 (ES) ..... 200401214 U

(51) Int. Cl.
*F24C 3/00* (2006.01)

(52) U.S. Cl. ..... 126/39 N; 126/39 E; 126/40; 126/39 BA; 248/58; 248/62; 251/143; 251/146; 137/318

(58) Field of Classification Search ..... 126/39 E, 126/39 H, 39 N; 251/143, 146; 137/318; 431/343; 248/48, 58, 62, 68.1, 49
See application file for complete search history.

(56) References Cited

U.S. PATENT DOCUMENTS

| | | | | | |
|---|---|---|---|---|---|
| 659,219 | A | * | 10/1900 | Niles | 415/60 |
| 670,748 | A | * | 3/1901 | Sheppard | 464/149 |
| 685,827 | A | * | 11/1901 | Du Perow | 104/115 |
| 1,279,297 | A | * | 9/1918 | Drohan | 248/74.4 |
| 1,445,984 | A | * | 9/1923 | Wilkinson | 126/39 E |
| 1,718,640 | A | * | 6/1929 | Erskine | 126/39 J |
| 1,722,411 | A | * | 7/1929 | Dilworth | 126/39 J |
| 1,869,764 | A | * | 8/1932 | Methudy | 126/39 B |
| 1,922,586 | A | * | 8/1933 | Hoffstetter et al. | 126/39 N |
| 1,925,810 | A | * | 9/1933 | Maul | 126/39 N |
| 2,039,652 | A | * | 5/1936 | Leonard | 126/39 N |
| 2,981,351 | A | * | 4/1961 | Knickerbocker et al. | 180/311 |
| 3,038,490 | A | * | 6/1962 | Yocum | 137/318 |
| 3,199,915 | A | * | 8/1965 | Hamilton et al. | 297/42 |
| 3,942,599 | A | * | 3/1976 | Shimada | 180/292 |
| 4,252,289 | A | * | 2/1981 | Herb | 248/62 |
| 4,860,724 | A | * | 8/1989 | Schlosser et al. | 126/38 |
| 6,619,279 | B1 | * | 9/2003 | Liao | 126/39 N |

FOREIGN PATENT DOCUMENTS

| | | | |
|---|---|---|---|
| DE | 27 12 659 | * | 10/1977 |
| EP | 0877206 | * | 11/1998 |
| GB | 2 182 136 | * | 5/1987 |
| GB | 2316456 | * | 2/1998 |
| JP | 2002-13725 | * | 1/2002 |
| WO | WO 01/73326 | * | 10/2001 |

* cited by examiner

*Primary Examiner*—Carl D. Price
(74) *Attorney, Agent, or Firm*—The Kline Law Firm

(57) ABSTRACT

The gas manifold assembly (1) is adapted to a cooking appliance for supplying the burners (21) thereof, and is equipped with various taps (C1-C4) of the rotary type, installed on a elongated tubular-shaped manifold conduit (2), which is disposed parallel to the front wall (FP) of the appliance and supported on it. The taps (C1-C4) have a respective installation seat (7) with a built-in gas intake connected to the elongated conduit (2), and mounting is carried out by means of a one-piece mounting device (12), which in turn has an integral means (12*b*) for supporting and fastening the manifold assembly (1) to the front wall (FP), for which purpose the aligned tap drive shafts (16) stand proud of the front wall (FP) and the tap outlet conduits (8) face and adjoin their respective burner (21).

6 Claims, 3 Drawing Sheets

GAS MANIFOLD ASSEMBLY WITH A MOUNTING DEVICE IN A COOKING APPLIANCE

TECHNICAL FIELD OF THE INVENTION

The present description relates not only to the supply of gas to a domestic cooking appliance provided with a number of top burners by way of a gas flow manifold assembly with a number of regulating taps of the rotary type installed on a manifold conduit, but also to the manifold assembly installation means.

PRIOR ART

Fuel gas manifold assemblies for a cooking appliance fitted with various rotary type taps are already known. The manifold assembly is installed on a front panel of the cooking appliance, with the aligned tap drive shafts placed so that they stand out from the front panel of the appliance. The taps are installed on a gas rail or manifold conduit by means of a tightening clamp with screws.

The gas manifold assembly disclosed for example in GB-2182429-A comprises a main manifold conduit or cylindrical section common rail on which various rotary manual taps are installed in line. The tap drive shafts extend in alignment by way of a front panel of the cooking appliance. The manifold conduit has its two ends sealed with plugs and each tap takes the gas flow from an individual hole in the gas rail or conduit manifold. The taps are the type that has an arched installation seat with a built-in gas intake. For the connection of the tap to the round conduit, the tap is provided with an arched based which is superimposed and encircles the manifold conduit with matching geometric forms, and it is fastened thereto by means of screws at both sides of the tubular conduit. The installation and fastening of the manifold assembly are done with mounting brackets, screwed at both ends of the manifold conduit, which are fixed to the front panel of the cooking appliance by means of screws. This manifold assembly uses one unitary means for fastening each tap to the gas rail, exclusively provided for this purpose. Separated means are used for supporting the manifold assembly onto the appliance panel.

The gas rail or manifold conduit shown in GB-2099129 is of elongated configuration, and the regulating taps are installed in alignment along the rail or conduit. On this known manifold assembly the gas conduit is fixed to the appliance spillage tray and separated from this by means of a number of additional fastening brackets. Installed on the middle part of the elongated gas conduit, this gas manifold assembly has a squared metal piece, separate from the taps, the function of which is to accommodate the gas conduit to the additional fastening means of the manifold assembly, thereby preventing upward movement of the front end of the spillage tray. This squared mounting piece is not therefore of use for fastening the taps to the gas conduit nor for fixing the manifold conduit to the wall of the appliance.

DISCLOSURE OF THE INVENTION

The object of the present invention is a gas manifold assembly equipped with a series of hand-operated taps, adapted to a cooking appliance for the supply of a gas flow to the top burners thereof. The taps being provided with an installation seat, are mounted on a manifold conduit having an elongated tubular-shaped configuration, and the tap drive shafts extending in alignment through a wall of the appliance, by means of a mounting device made of a single piece on each tap. The manifold assembly is installed on the front panel once the taps are fitted on the manifold conduit, and fastened to said panel by means of various mounting devices, each one being thus used at the same time for fastening each tap to the gas conduit.

The manifold assembly according to the invention is of a simple configuration and easy to install. The manifold conduit is circular section, suited for the fitting of a typical gas tap of the type with an arched installation seat and a built-in gas intake. The manifold assembly includes various mounting device made of a one-piece, which in its entirety comprises an initial U-shaped component part for fastening on the manifold conduit and a second component part for fastening the manifold assembly directly to the wall of the cooking appliance.

DETAILED DESCRIPTION OF THE PREFERRED EMBODIMENT

Figure 1:
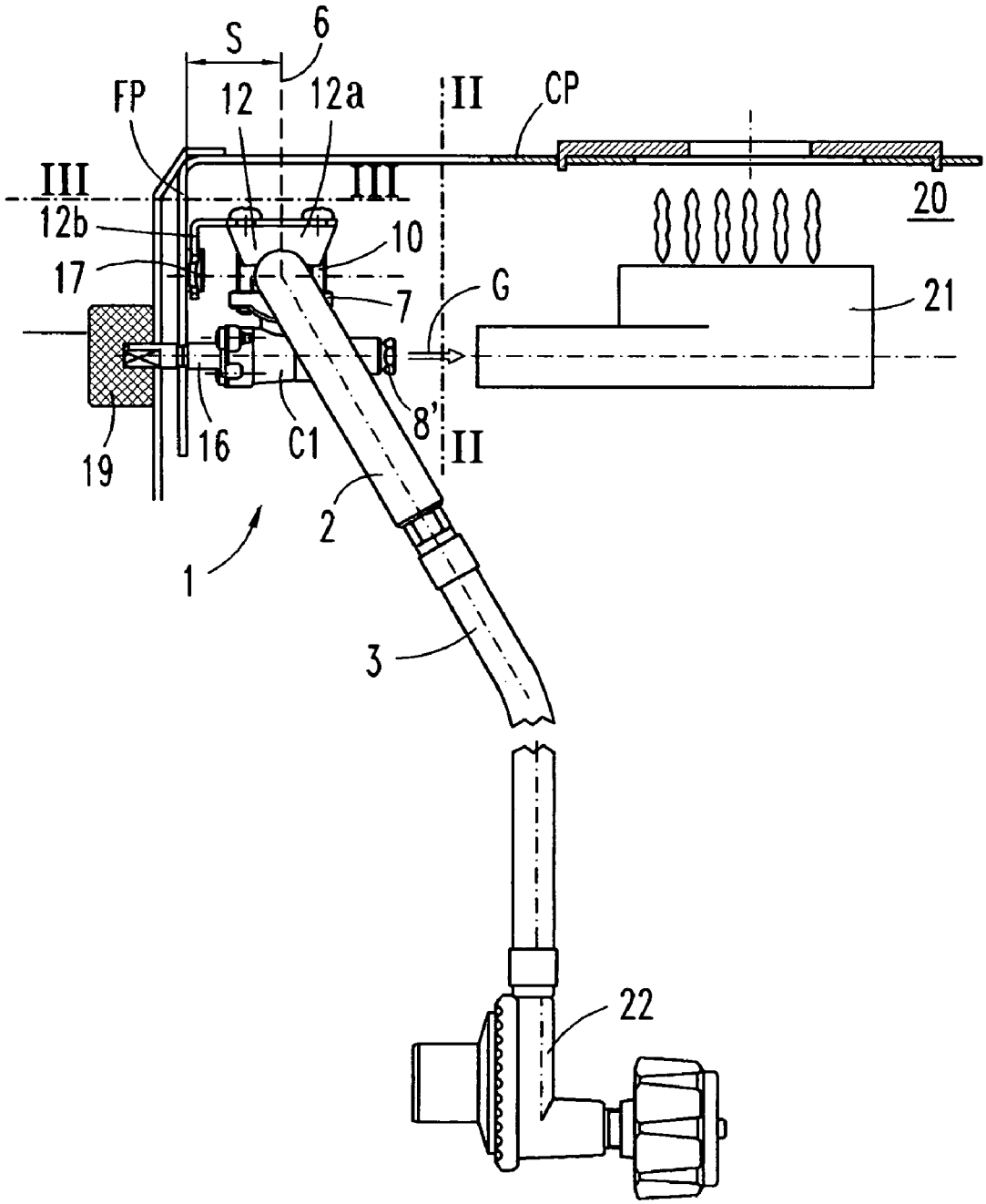
FIG. 1 is a profile view of a gas manifold assembly mounted on the front panel of a cooking appliance.

In reference to FIGS. 1-4, the gas manifold assembly according to one embodiment of the invention is installed on a cooking appliance 20 with top burners 21 forming a working plane CP. The manifold assembly comprises an elongated manifold conduit 2 of a straight preferably cylindrical configuration, a feed pipe 3 connected to one end of the manifold conduit, two or more rotary taps C1-C4, four instance four taps mounted in line on the manifold conduit 2 and various squared mounting device 12, each one for either one of the taps C1-C4, which are used also as a means for installing the manifold assembly 1 on the front panel FP of the cooking appliance 20.

The gas manifold conduit 2 has a straight part running parallel to the front panel FP of the appliance, on which there are four taps C1-C4 disposed and a bent part extending towards the inside of the appliance, at the end of which the flexible feed hose is connected from a gas supply regulator 22.

Figure 2:
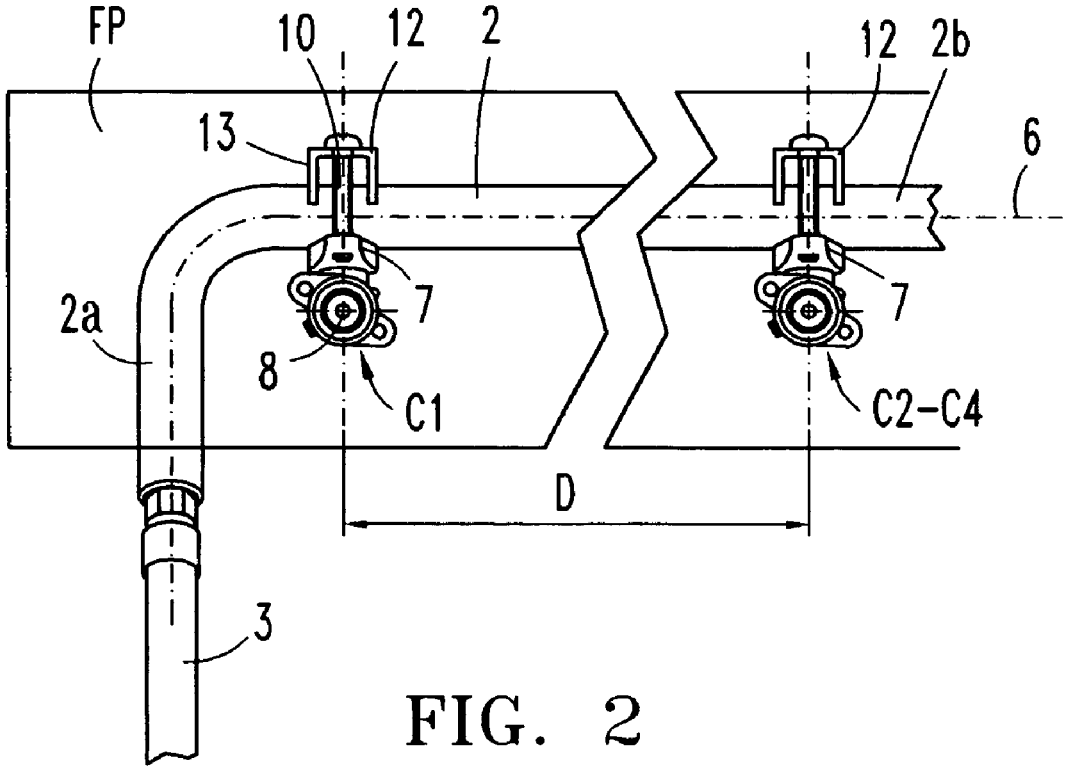
FIG. 2 is a partial elevational view of the gas manifold assembly of FIG. 1.
Figure 3:
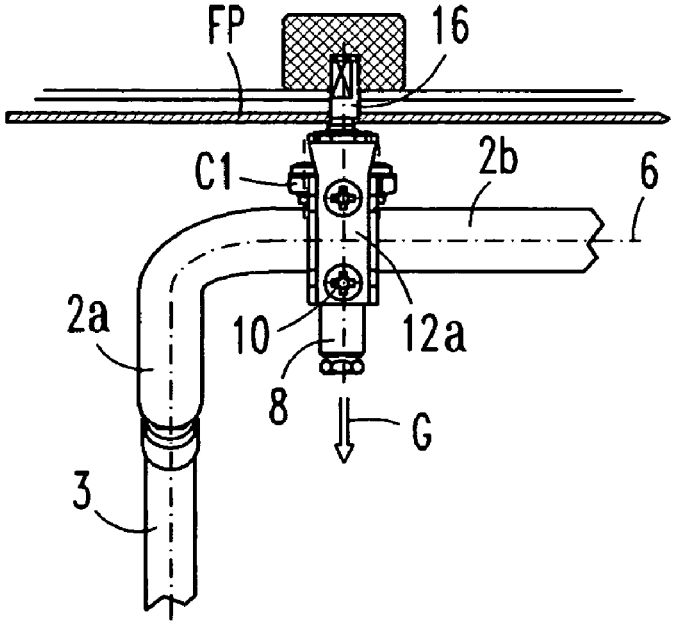
FIG. 3 shows a plan view of a detail of the fastening of a tap on the manifold assembly of FIG. 1.
Figure 4:
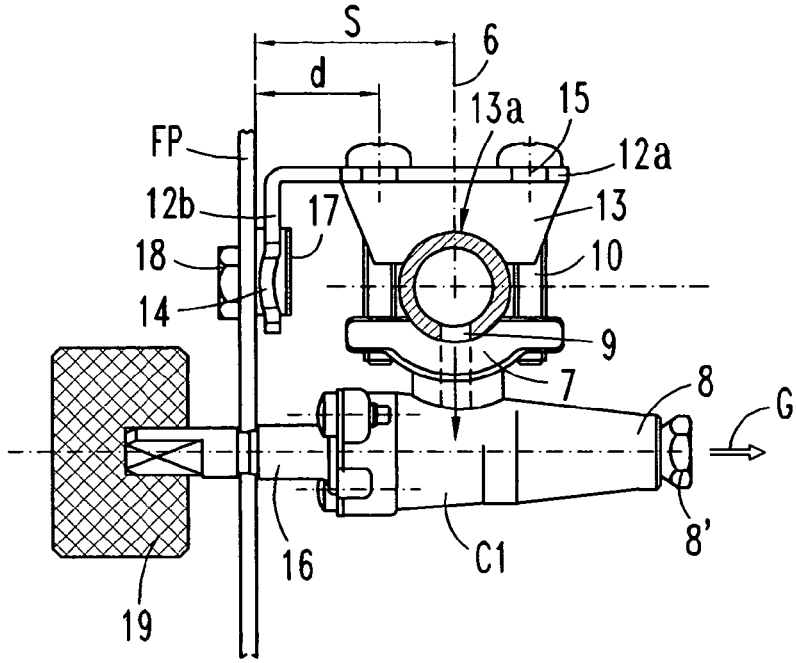
FIG. 4 shows a detail view of the installation of a tap on the manifold assembly of FIG. 1.

Taps C1-C4 have an arched installation seat 7 for superimposing on a cylindrical wall of the gas conduit 2, wherein it is connected to an individual gas intake hole 9 of conduit 2. Taps C1-C4 supply an individual gas flow "G" to each top burner 21, for which purpose they are provided with a tap outlet conduit 8 and a gas injector 8' adjacent to the respective burner 21. The tap drive shafts 16 have a horizontal orientation towards the front panel FP, aligned and spaced a distance "D" apart from one another (FIG. 2). Every tap C1-C4 is connected by way of an individual gas intake conduit 9 to the aforesaid gas intake hole 9 in the manifold conduit 2.

Figure 5:
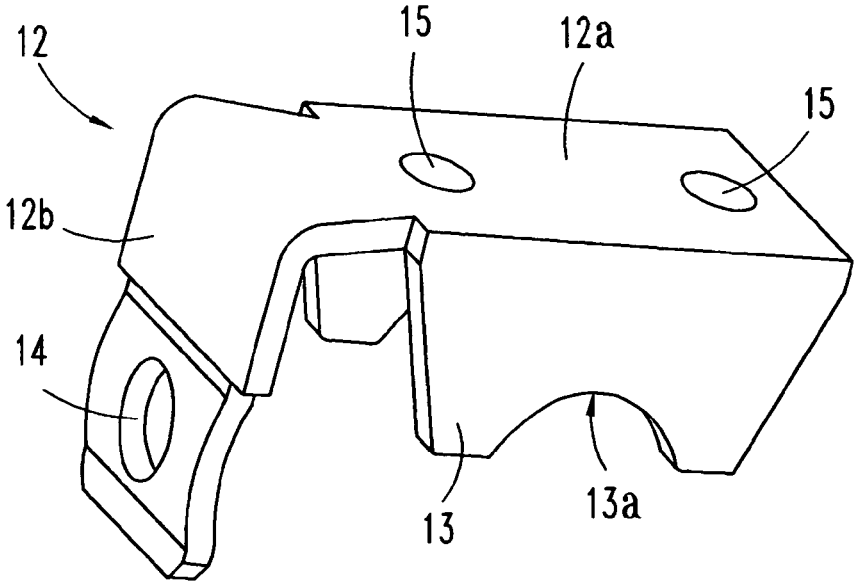
FIG. 5 is a perspective view of an mounting device used on the manifold assembly of FIG. 1.

In reference to FIG. 5, a close view of an embodiment of a mounting device 12 made of a single squared piece is shown. The mounting device 12 is used for fastening a tap C1-C4 to the gas conduit 2, and at the same time for supporting the manifold assembly 1. The mounting device 12 is superimposed on the rounded wall of the gas conduit 2 (FIG. 3) opposite sided from the tap seat 7. Thus the manifold conduit is clamped between a tap C1-C4 and a mounting device 12 by means of two fastening bolts 10.

The mounting device according to the embodiment shown in FIG. 5 is made of a one-piece, for instance of pressed metal plate or molded plastic, with two differentiated parts for its dual function. A first part 12*a* of the device having a U-shaped profile has a contact zone at its two arms 13 with a respective arched surface 13*a* resting on a cylindrical wall of the gas conduit 2, and at its flat base it has two holes 15 for inserting the two fastening bolts 10, facing the threaded holes in the tap installation seat 7. A second part 12*b* of the device for fastening the manifold assembly 1 to the front wall FP of the appliance, comprises a squared wing extending in a vertical direction traverse to the manifold conduit 2, having a through-hole 14 for a screw 18 by means of which the mounting device 12 is attached to the wall FP of the appliance.

At least two of the mounting devices 12 keeps the axis 6 of the elongated conduit 2 parallel to the wall panel FP and at a given spacing distance "S", while each one also maintains a respective tap C1-C4 spaced at a given distance "d" away from the same wall or panel FP. Thus a snug position is achieve for the tap shafts 16 and its rotary control button 19 on the panel FP. The edge of the squared wing 12*b* with the fixing hole 14 is inserted for its accurate positioning in a retaining housing 17 (FIG. 3) belonging to a front wall FP, which in turn is used as a lock nut for the attaching screw 18.

What is claimed is:

1. A gas manifold assembly adapted to a cooking appliance for the supply of an individual gas flow (G) to burners of the appliance, comprising:

an elongated gas manifold conduit (2) connected to a feed pipe (3) from a gas source of the appliance, the elongated gas manifold conduit (2) being provided with a series of spaced gas supply holes (9);

a plurality of gas taps (C1-C4) each provided with a rotary drive shaft (16) and an installation seat (7) integral to a tap body and having a built-in gas intake connected to one of said supply holes (9) in the elongated gas manifold conduit (2);

wherein the cooking appliance has a horizontal working plane (CP) with the burners and a vertical front wall (FP) supporting the manifold assembly (1) with the elongated conduit (2) oriented parallel to the front wall (FP);

means for installing and fastening the gas taps (C1-C4) on the manifold conduit (2) such that the gas taps (C1-C4) are spaced apart from each other along the length of the manifold conduit (2);

means (14, 17, 18) for supporting the manifold assembly (1) on the front wall (FP) of the appliance, with the tap shafts (16) projecting outwards from the front wall (FP); and a mounting device (12) formed independently from the wall (FP) for each tap (C1-C4), each mounting device (12) being provided with said means for installing and fastening the gas taps (C1-C4) on the elongated conduit (2), and wherein the mounting devices (12) associated with each gas tap (C1-C4) cooperate with each other to support the manifold assembly (1) that is attached to said front wall (FP) and is separated by a given space (S) therefrom, the manifold assembly (1) thereby forming an independent unit removable from the appliance.

2. The gas manifold assembly according to claim 1, wherein said tap mounting device (12) has a first device part (12*a*) formed with a V-shaped profile, the two arms of which (13) having a contact surface (13*a*) for bearing on a rounded area of the elongated conduit (2) and the base of which contains two through holes (15) that receive tap fastening bolts (10), and a second device part (12*b*, 14) for supporting the manifold assembly (1), the second device part being a wing bent at a right angle to rest on said front wall (FP) and separating the respective tap (C1-C4) from the front wall (FP).

3. The gas manifold assembly according to claim 1, wherein said means (14, 17, 18) for supporting the manifold assembly (1) include a retaining housing (17) attached to the front wall (FP), in which a squared wing (12*b*) of the one-piece mounting device (12) is inserted for the exact positioning of the manifold assembly (1) and the tap drive shafts (16) relative to the front wall (FP).

4. The gas manifold assembly according to claim 1, wherein each of the gas taps (C1-C4) is provided with an outlet conduit (8) fitted with a gas flow injector (8') facing towards the respective burner, and said mounting device (12) is provided with a right-angle wing (12*b*) attached to the front wall (FP) of the cooking appliance, for guiding and positioning said outlet conduit (8) of the tap (C1-C4) next to the respective burner (21).

5. A gas manifold assembly adapted to a cooking appliance for the supply of an individual gas flow (G) to burners of the appliance, comprising:

an elongated gas manifold conduit (2) connected to a feed pipe (3) from a gas source of the appliance and provided with a series of spaced gas supply holes (9);

a plurality of gas taps (C1-C4) each provided with a rotary drive shaft (16) and an installation seat (7) integral to the tap body and having a built-in gas intake connected to one of said supply holes (9) in the elongated conduit (2);

wherein the cooking appliance has a horizontal working plane (CP) with the burners and a vertical front wall (FP) supporting the manifold assembly (1) with the elongated conduit (2) oriented parallel to the wall (FP);

a mounting device (12) for supporting the manifold assembly (1) to said front wall (FP), formed in one-piece for each tap (C1-C4), which comprises a first device part (12*a*, 13) for fastening the tap on the gas manifold conduit (2) by means of bolts (10) through said tap seat (7), and a second device part (12*b*, 14) in the form of an integral extension (12*b*) from the first device part (12*a*, 13), and being attached to said front wall (FP), and keeping the manifold assembly (1) in a position separated by a given space (S) from the front wall (FP).

6. The gas manifold assembly according to claim 5, wherein said first device part (12*a*, 13) for fastening the tap (C1-C4) has a U-shaped configuration, the two arms of which form a bearing surface (13*a*) conforming in shape to a rounded surface of the gas conduit (2), the base (12*a*) of the first device part extends transversely to said flat panel wall (FP) with a squared wing end (12*b*) for resting on the front wall (FP), the tap (C1-C4) being separated therefrom and with said outlet conduit (8) of the tap adjoining and facing a respective burner (21).

* * * * *